US009212598B2

(12) United States Patent
Platt et al.

(10) Patent No.: US 9,212,598 B2
(45) Date of Patent: Dec. 15, 2015

(54) MODULAR COOLING UNIT FOR AUTOMOTIVE VEHICLE

(71) Applicants: Richard Booth Platt, Grosse Pointe Farms, MI (US); Rick Anthony Hobbs, Sterling Heights, MI (US)

(72) Inventors: Richard Booth Platt, Grosse Pointe Farms, MI (US); Rick Anthony Hobbs, Sterling Heights, MI (US)

( * ) Notice: Subject to any disclaimer, the term of this patent is extended or adjusted under 35 U.S.C. 154(b) by 96 days.

(21) Appl. No.: 13/919,314

(22) Filed: Jun. 17, 2013

(65) Prior Publication Data

US 2014/0366816 A1 Dec. 18, 2014

(51) Int. Cl.
*F01P 3/20* (2006.01)
*F01P 3/18* (2006.01)

(52) U.S. Cl.
CPC ... *F01P 3/20* (2013.01); *F01P 3/18* (2013.01); *F01P 2060/02* (2013.01); *Y10T 137/6579* (2013.01)

(58) Field of Classification Search
CPC .... F28D 1/024; F28D 1/0408; F01P 2070/50; F01P 3/18; F01P 2060/02; F01P 2060/04; F01P 7/02
USPC ..... 123/41.3, 41.11, 41.49, 41.43, 41.56, 123/41.55, 41.63; 165/121, 41, 140, 149, 165/67, 104.33
See application file for complete search history.

(56) References Cited

U.S. PATENT DOCUMENTS

| | | | | |
|---|---|---|---|---|
| 3,795,274 | A * | 3/1974 | Fieni | B60K 11/04 165/122 |
| 5,522,457 | A * | 6/1996 | Lenz | F28D 1/024 123/41.49 |
| 5,771,961 | A * | 6/1998 | Alizadeh | B60K 11/04 165/121 |
| 6,732,681 | B1 * | 5/2004 | Hendricks, Sr. | F01P 3/18 123/41.49 |
| 8,313,282 | B1 * | 11/2012 | Jarrah | F04D 13/14 165/104.33 |
| 2006/0130454 | A1 * | 6/2006 | Liang | F02C 6/18 60/39.01 |

OTHER PUBLICATIONS http://www.griffinrad.com/Universal_Combos.cfm.
http://www.griffinrad.com/combo_unit.cfm.
http://automotive.flex-a-lite.com/radiators/universal.html.
http://automotive.flex-a-lite.com/radiators/direct-fit.html.

* cited by examiner

*Primary Examiner* — Lindsay Low
*Assistant Examiner* — Long T Tran
(74) *Attorney, Agent, or Firm* — Jerome R. Drouillard

(57) ABSTRACT

A modular cooling unit particularly useful for an automotive vehicle is configured with a heat exchanger having a tunnel port extending at least part way through the core of the heat exchanger. The case of a cooling fan motor is mounted within the tunnel port, so as to minimize the overall length of the cooling unit.

3 Claims, 5 Drawing Sheets

MODULAR COOLING UNIT FOR AUTOMOTIVE VEHICLE

TECHNICAL FIELD

The present disclosure relates to a modular cooling unit for vehicular use. The unit features a heat exchanger and a fan motor mounted within a tunnel port extending at least partly through a core portion of the heat exchanger.

BACKGROUND

The provision of adequate powerplant cooling is one of the most important design considerations facing automotive designers, and this is true with both purely engine driven and hybrid vehicles. Ubiquitous air-to-liquid heat exchanger systems utilize an air-cooled radiator core and an electro drive fan. Of course, when designing a new vehicle it is usually possible to package both the radiator core and the fan without undue difficulty. However, the dictates of styling and crashworthiness sometimes result in extremely limited space for the radiator and fan, necessitating unwanted design compromises. Moreover, inadequate space between the engine and the radiator grille may be particularly acute in the case of vehicles having extensive modifications including aftermarket engines, intercooling, and air conditioning. This may exacerbate cooling problems for higher performance vehicles. It would be desirable to provide a modular unit with excellent cooling performance, while using less underhood space, and particularly, less longitudinal space as measured from the forwardmost part of the engine to the front of a vehicle.

SUMMARY

According to an aspect of the present invention, a modular cooling unit for an automotive vehicle includes an air-cooled heat exchanger core and a fan for moving air through the heat exchanger core, with the fan including a motor and a fan blade attached to the motor. The modular cooling unit further includes a mount attaching the motor to the heat exchanger core, with the mount having a tunnel port extending into or through the heat exchanger core, and with the motor being housed at least partially within the tunnel port.

Those skilled in the art will appreciate in view of this disclosure that a tunnel port according to this invention need not pass entirely through a core portion of a heat exchanger; it is possible to achieve a reduction in the installed length of the modular cooling unit if the fan motor is housed at least partially within a port extending part way through a heat exchanger core.

According to yet another aspect of the present invention, a heat exchanger core includes a plurality of tubes for conducting a fluid being cooled, with a fan motor mounting bracket being attached to a plurality of the tubes within a tunnel port defined in the heat exchanger core, whereby fluid is confined within the tubes to which the bracket is attached.

According to yet another aspect of the present invention, a fan motor mount may include an inlet header and an outlet header, with both communicating with a plurality of the radiator tubes, and with the mount further including a bypass connecting the inlet header to the outlet header, whereby fluid being cooled will be permitted to flow around, or past, the motor and through the tubes to which the mount is attached.

According to yet another aspect of the present invention, a cooling module fan motor mount may include an inner, generally cylindrical mo housing and an outer generally cylindrical header connected with a number of fluid-conducting tubes laterally disposed on two sides of the motor, with the generally cylindrical motor housing and the generally cylindrical header defining an annular coolant flow path extending within a heat exchanger tunnel port from one lateral side of the motor to another lateral side of said motor, whereby coolant will be allowed to circulate through the tubes to which the mount is attached.

It is an advantage of the present modular cooling unit that much less longitudinal space is required for the combined radiator core and fan assembly because the fan motor is mounted within a tunnel port extending into or through the radiator core itself. As used herein, the terms 'radiator core' or 'heat exchanger core' mean an assembled unit consisting essentially of fluid-conducting tubes joined into a generally flat bundle having cooling fins extending between adjacent tubes. A radiator core is a type of heat exchanger core in which the tubes carry engine coolant. An air conditioning condenser is a heat exchanger core in which the tubes carry refrigerant flowing from a compressor to an accumulator while changing phase from a gas to a liquid.

It is a further advantage that the present cooling unit may be employed for temperature control of not only water-based engine coolants, but also for charge air cooling, oil, cooling, or yet other types of cooling. Moreover, the present cooling unit may be equipped with an electric, or hydraulic, or air-powered motor.

It is yet a further advantage that the present cooling unit is ideally suited for application in the automotive aftermarket because it simplifies the installation of additional cooling capacity in many vehicles. Those skilled in the art will appreciate in view of this disclosure that this cooling unit could be used beneficially in automotive HVAC systems in conjunction with either a heater core or an evaporator core, or both.

Other advantages, as well as features of the present invention, will become apparent to the reader of this specification.

DETAILED DESCRIPTION

Figure 1:
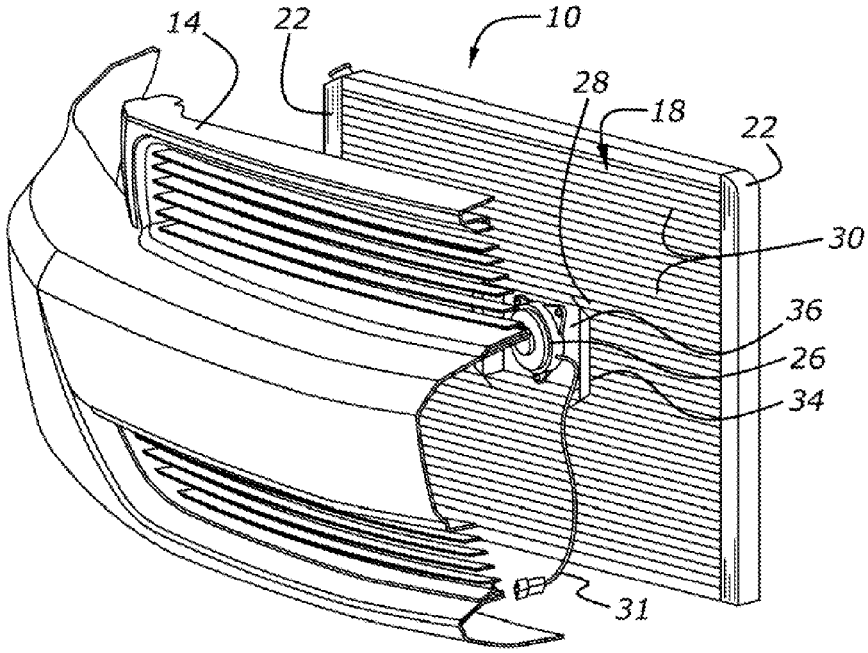
FIG. 1 is a perspective view of a radiator grille and heat exchanger system according to an aspect of the present invention.

As shown in FIG. 1, the present space-saving, modular cooling unit, 10, is ideally located in close proximity to an automotive vehicle grille, 14. Those skilled in the art will appreciate in view of this disclosure that the inventive system may be employed in vehicles equipped with either an internal combustion engine, or other type of heat engine, or an electrodrive or fuel cell powerplant or any hybrid thereof. And, the fluid being cooled may be charge air, engine coolant, engine lubricant, cabin air, or other fluids flowing through the illustrated heat exchanger core, 18. FIG. 1 also shows end tanks 22 and tubes 30 extending in the usual manner characterizing a crossflow heat exchanger. Alternatively, this invention could be used with a vertical flow heat exchanger. Further flexibility exists in the choice of a fan motor having a case 26, which may be either an electrodrive, or hydraulic, or air drive, or other type of motor known to those skilled in the art and suggested by this disclosure. Accordingly, conductor 31 may be either an electrical conductor, or a hydraulic or pneumatic or other type of fluid conductor.

Figure 3:
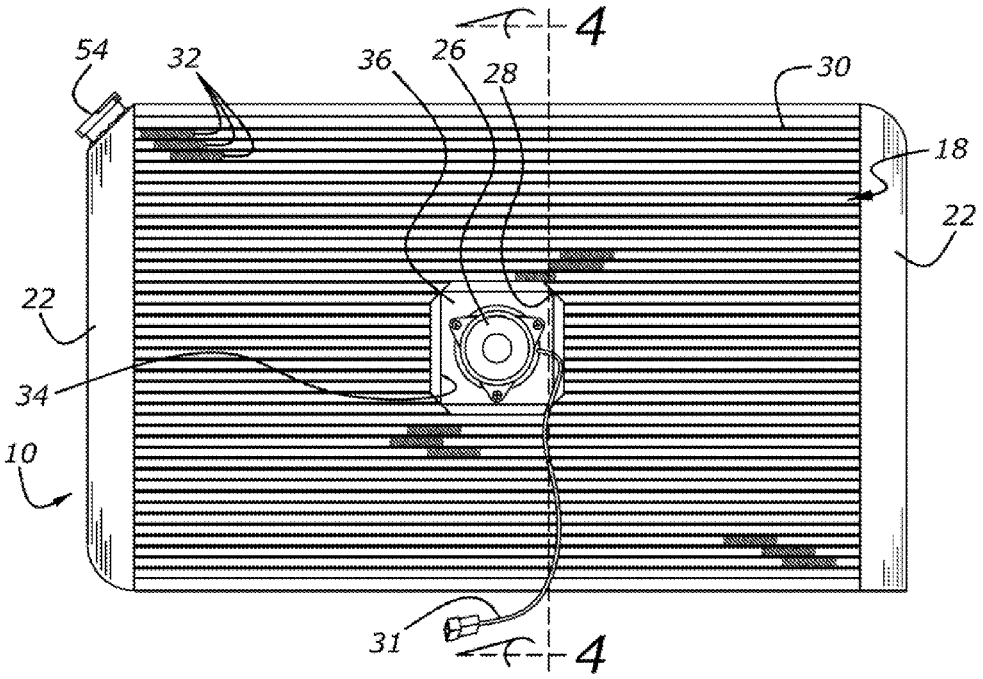
FIG. 3 is a front elevation of the heat exchanger system of FIGS. 1 and 2.
Figure 4:
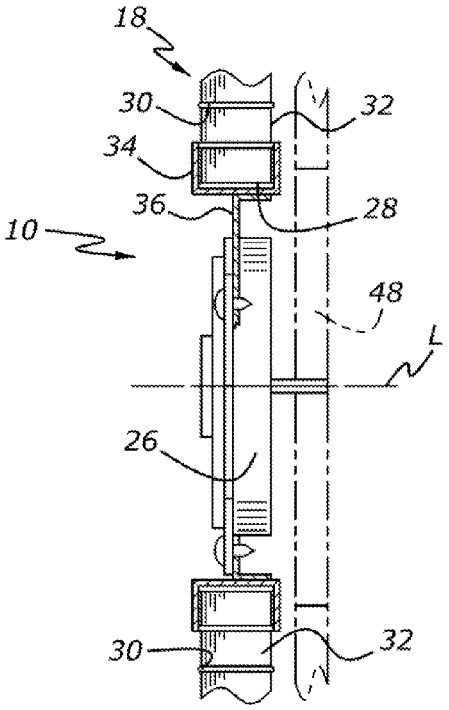
FIG. 4 is a lateral sectional view, partially broken away, of eat exchanger system of FIGS. 1-3, taken along the line 4-4 of FIG. 3.

FIGS. 1, 3 and 4 further include fan motor having a case 26 and a motor mounting bracket. In a first preferred embodiment, the mounting bracket includes a tunnel engagement portion, 34, which extends to the front and rear faces of core 18. As shown in FIGS. 1, 3 and 4, tunnel engagement portion 34 extends into tunnel port 28 fashioned in core 18, while motor plate 36 provides a secure platform for mounting motor case 26 directly to core 18 without the need for additional brackets or pins extending between adjacent tubes. Those skilled in the art will appreciate in view of this disclosure that motor plate 36 may welded or otherwise mechanically fastened or bonded to tunnel engagement portion 34. Because motor case 26 is not cantilevered to one side of core 18, the present invention greatly reduces the chances of inducing structural failure of the core as compared with other mounting schemes.

Tunnel port 28 allows the completed assembly of core 18, motor 26, and axial flow fan 46, 48 to be much shorter, (as measured along axis 'L' of FIG. 4), than conventional assemblies in which the fan motor resides outside of the heat exchanger core. This advantage lies at the heart of the present inventive heat exchanger assembly and permits the assembly to be retrofitted in vehicles having more restrictive engine compartments. Those skilled in the art will further appreciate in view of this disclosure that the particular design of bracket 34 is a matter of design choice; what is important is that motor case 26 and tunnel port 28 extend at least partially through core 18 of the heat exchanger.

Figure 2:
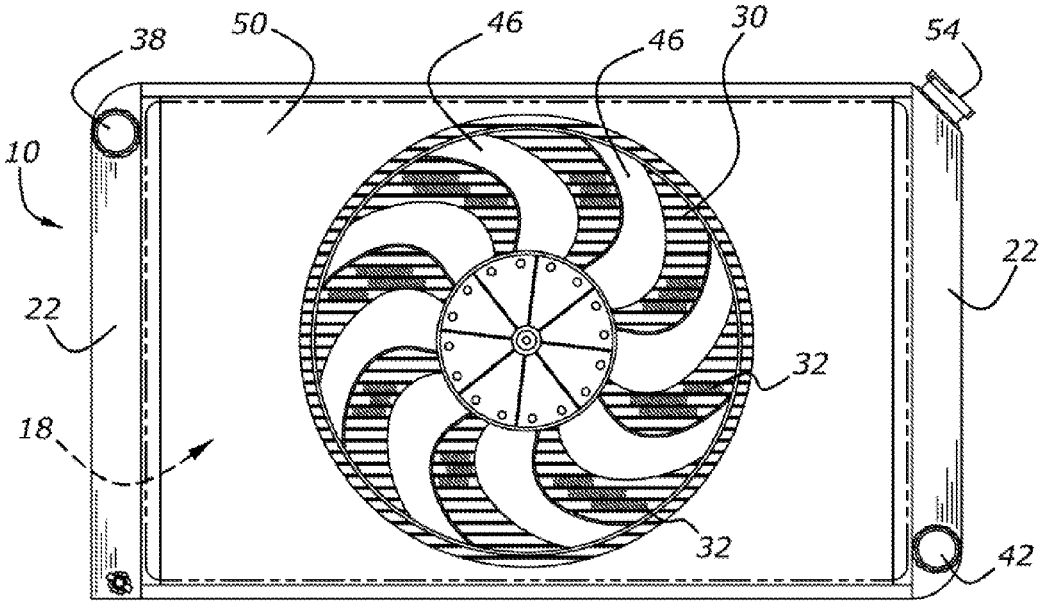
FIG. 2 is a rear elevation of the heat exchanger system of FIG. 1.

FIG. 2 illustrates a number of details of the present modular cooling unit, such as fluid inlet 38, fluid outlet 42, supply port 54, crossflow tubes 30, core fins 32, and s-shaped fan blades 46. Alternatively, straight blades are shown schematically in FIG. 4. FIG. 2 also shows fan shroud 50 which cooperates with puller fan 46 to provide efficient airflow past the greatest possible area of core 18.

Figure 5:
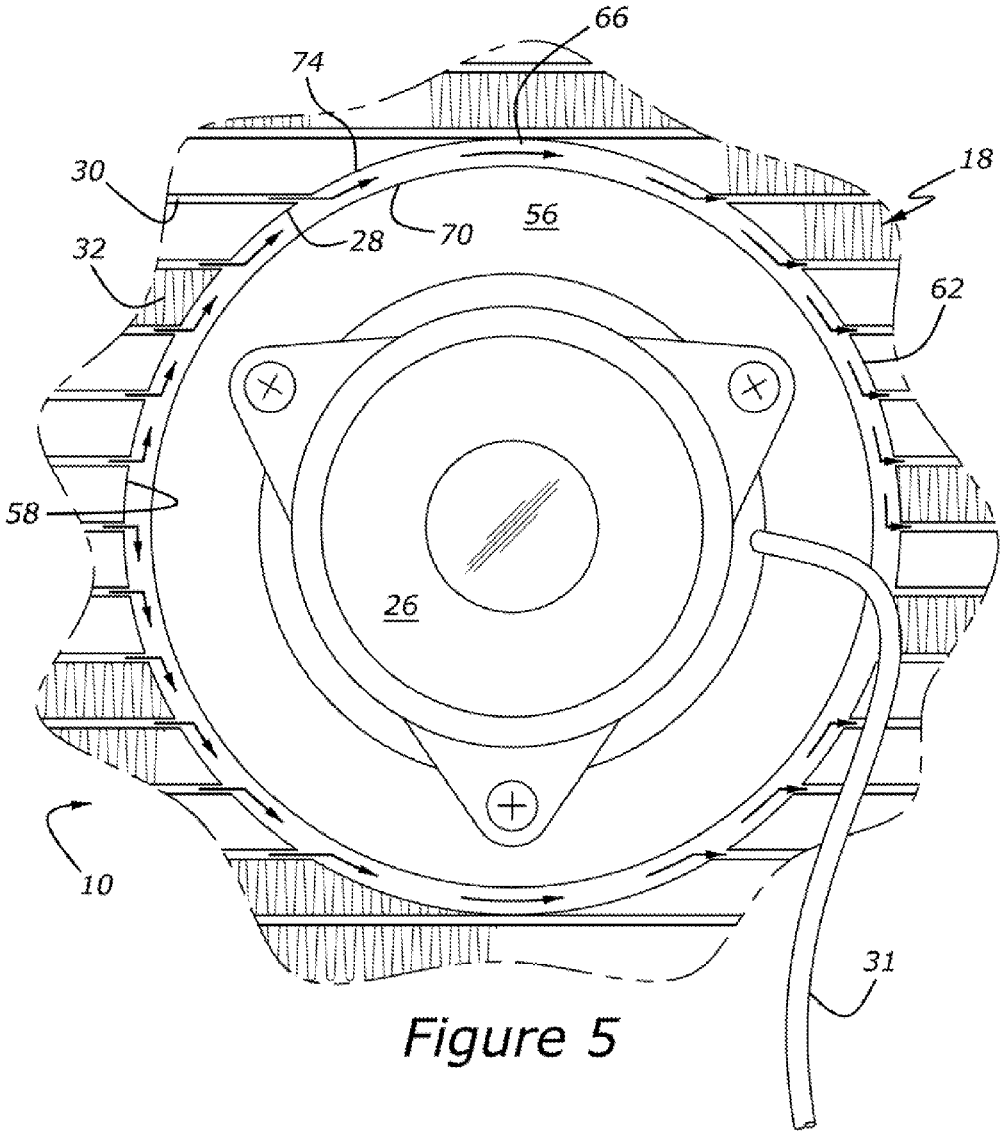
FIG. 5 is a plan view of a combination cooling flow bypass and fan motor mount according to an aspect of the present invention.

Although the fluid tubes 30 located adjacent bracket 34 in FIGS. 1, 3 and 4 are stubbed off or otherwise terminated to permit installation of bracket 34 and fan motor case 26 without fluid handling capability, performance of the present modular cooling unit is not greatly compromised. Nevertheless, if maximum heat transfer capacity is desired, the configuration of FIG. 5 is available according to yet another aspect of the present invention. In this embodiment, motor platform 56 extends within a generally cylindrical motor housing port, 70, mounted within tunnel port 28. Motor housing port 70 cooperates with an outer generally cylindrical header, 74, to define an annular coolant flow path or bypass section, 66, circumscribing motor platform 56. Fluid moving through tubes 30 in that section of core 18 which is adjacent tunnel port 28 first flows into inlet header section 58 and then through bypass section 66 before exiting through outlet header section 62. In this manner the subset of tubes 30 adjacent to motor case 26 will have fluid flow around tunnel port 28 contributing to the performance of the modular cooling unit. As with the earlier embodiment, the fan motor is supported solely by tubes 30 and fins 32.

Figure 6:
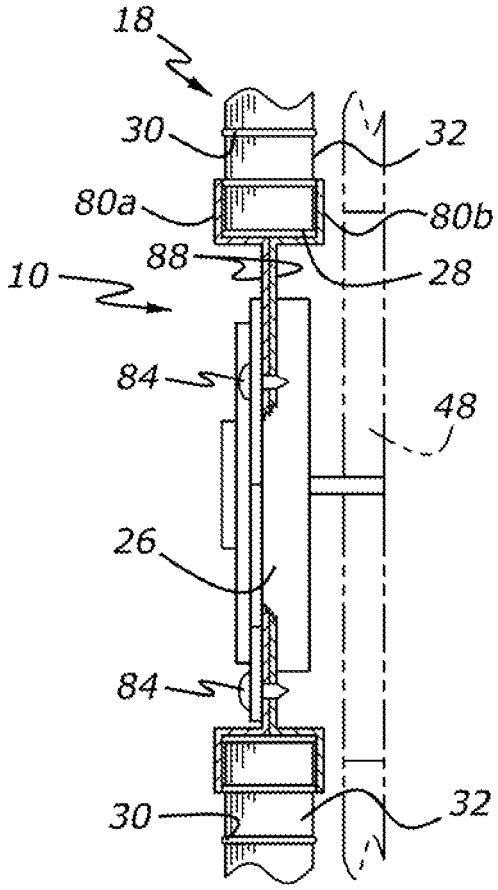
FIG. 6 is similar to FIG. 4 and shows an alternative construction for a fan motor mounting bracket according to the present invention.

FIG. 6 shows a second preferred embodiment in which a fan motor mounting bracket includes two generally cup-shaped tunnel engagement portions—80*a*, which extends through tunnel 28 to the front of heat exchanger core 18, and portion 80*b*, which extends to the rear of core 18. As shown in FIG. 6, the extension of generally cup-shaped tunnel engagement portions 80*a* and 80*b* into tunnel port 28 permits elements 80*a* and 80*b* to sandwich heat exchanger core 18 so as to provide a secure platform for mounting motor case 26. In essence, motor platform 88 is defined by base portions of the cup-shaped elements 80*a* and 80*b*.

The embodiment of FIG. 6 is ideally suited for use in the automotive aftermarket as an accessory for modifying an existing cooling unit. Once port 28 has been provided by shortening and stubbing off a portion of tubes 30 and fins 32 of core 18, tunnel engagement portions 80*a* and 80*b* may be joined, either with the fasteners 84 which attach motor case 26, or by other mechanical or bonding systems known to those skilled in the art and suggested by this disclosure.

Figure 7:
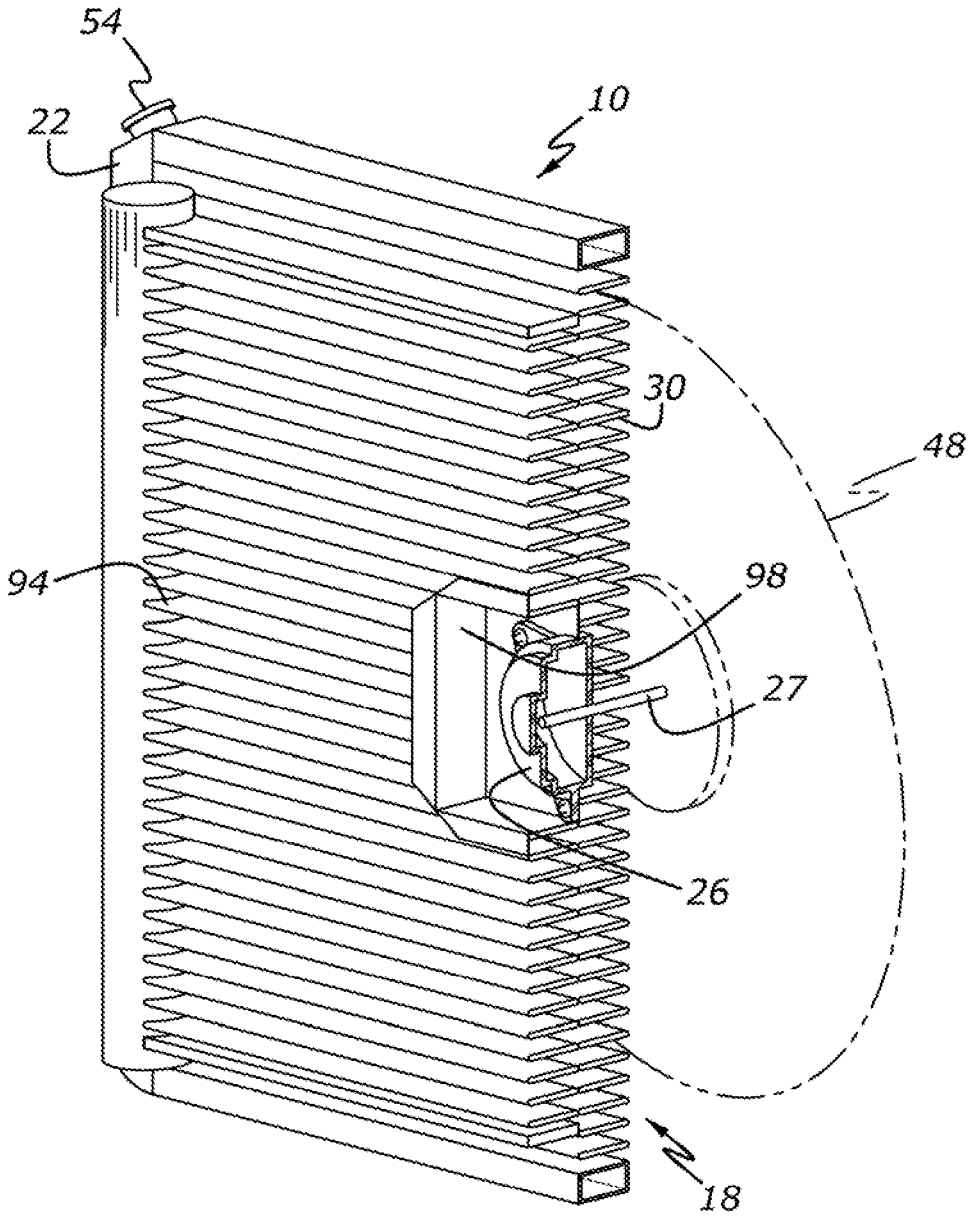
FIG. 7 is a perspective view, partially cut away, of a heat exchanger system according to an aspect of the present invention.

FIG. 7 illustrates an embodiment in which an air conditioning condenser, 94, is mounted adjacent a front face of heat exchanger core 18, which is shown as an engine cooling radiator. As with earlier embodiments, fan motor case 26 is housed within a tunnel port, 98, but unlike earlier embodiments, port 98 is formed in condenser 94, not in heat exchanger core 18. Fan 48, located adjacent the back face of radiator core 18, is driven by a shaft, 27, extending from motor case 26 between adjacent tubes 30 of core 18. This configuration accomplishes two important objectives. Namely, the overall length, or thickness, of the combined radiator and A/C condenser is reduced, while the cooling capacity of radiator core 18 is only minimally impacted because none of tubes 30 is required to be either headed off or otherwise terminated. This embodiment is especially attractive to car builders wishing to install air conditioning in a vehicle having limited clearance distance between the engine and the ornamental exterior grille, as measured along the axis L of FIG. 4.

It should be understood that the foregoing description and the embodiments thereof are merely illustrative of many possible implementations of the present invention and are not intended to be exhaustive.

The invention claimed is:

1. A cooling module for an internal combustion engine installed in an automotive vehicle, comprising:

an air-cooled radiator core comprising a plurality of fluid-conducting tubes and a plurality of fins extending between adjacent ones of said tubes;

a shrouded fan moving air through the radiator core, with said fan comprising an electric motor and a fan blade attached to said motor; and a mount attached to a plurality of said tubes, with said mount comprising a motor housing tunnel port extending through the radiator core, and with the mount further comprising a mount bracket defining a fluid bypass permitting fluid flow through the tubes to which mount is attached and around the tunnel port within which the motor is mounted, wherein said mount bracket comprises a generally cylindrical motor housing and an outer generally cylindrical header connected with a plurality of said fluid-conducting tubes laterally disposed on two sides of said motor, with said generally cylindrical motor housing and said generally cylindrical header defining an annular coolant flow path extending from one side of said motor to another side of said motor, whereby coolant will be allowed to circulate through the tubes to which the mount is attached.

2. The cooling module according to claim 1, wherein said radiator core comprises a crossflow heat exchanger.

3. A modular cooling unit for an automotive vehicle, comprising:

an air-cooled heat exchanger core comprising a plurality of tubes for conducting a fluid being cooled;

a fan for moving air through the heat exchanger core, with said fan comprising a motor having a case, and a fan blade attached to said motor; and a mount attaching said motor to said heat exchanger core, with said mount comprising a tunnel port extending at least partly through said heat exchanger core, with said motor case being housed within said tunnel port, and with said mount being attached to a plurality of said tubes and further comprising an inlet header and an outlet header both communicating with a plurality of said tubes, and with said mount further comprising a bypass connecting said inlet header to said outlet header, whereby fluid being cooled will be permitted to flow around the motor and through the tubes to which the mount is attached.

* * * * *